US012318705B1

(12) United States Patent
Van Rosendale

(10) Patent No.: US 12,318,705 B1
(45) Date of Patent: Jun. 3, 2025

(54) SYSTEM FOR MODELING ANIMATED ARTIFICIAL WATER SURFACES

(71) Applicant: John R. Van Rosendale, Bellingham, WA (US)

(72) Inventor: John R. Van Rosendale, Bellingham, WA (US)

( * ) Notice: Subject to any disclaimer, the term of this patent is extended or adjusted under 35 U.S.C. 154(b) by 0 days.

(21) Appl. No.: 19/039,008

(22) Filed: Jan. 28, 2025

(51) Int. Cl.
*G09B 25/08* (2006.01)
*A63H 33/42* (2006.01)
*A63J 13/00* (2006.01)

(52) U.S. Cl.
CPC ..... *A63J 13/00* (2013.01); *A63H 33/42* (2013.01)

(58) Field of Classification Search
CPC ..... G09B 25/00; G09B 25/08; G09B 29/12; A63J 1/00; A63J 1/02; A63J 13/00; A63H 33/42
See application file for complete search history.

(56) References Cited

U.S. PATENT DOCUMENTS 754,533 A * 3/1904 Austen ..... A63J 1/02 472/77
2,211,353 A * 8/1940 Solkover ..... A63J 13/00 472/65
2,413,633 A * 12/1946 Jones ..... G09B 9/305 472/59
3,785,065 A * 1/1974 Kamm ..... G09B 25/08 434/93
3,802,697 A * 4/1974 Le Mehaute ..... A63G 3/02 4/491
5,326,267 A * 7/1994 Brokaw ..... G09B 25/06 434/152
6,336,771 B1 * 1/2002 Hill ..... A63G 31/007 4/491
6,491,589 B1 * 12/2002 Lochtefeld ..... A63C 19/00 472/117
6,852,000 B2 2/2005 Lee et al.
11,037,353 B2 * 6/2021 Doidic ..... G06T 13/60
RE49,215 E * 9/2022 McFarland ..... E04H 4/0006

* cited by examiner

*Primary Examiner* — Kurt Fernstrom
(74) *Attorney, Agent, or Firm* — Peter J. Van Bergen

(57) ABSTRACT

Methods and systems are described for an animated artificial water surface. A sheet of material having a glossy surface includes a three-dimensional pattern of waves extending along horizontal dimensions of the sheet. The waves have a scale-model height profile. A drive may be coupled to the sheet. The drive may be operable to move at least a portion of the sheet continuously and at a constant speed in one direction relative to the horizontal dimensions of the sheet wherein the waves model an animated water surface.

21 Claims, 6 Drawing Sheets

SYSTEM FOR MODELING ANIMATED ARTIFICIAL WATER SURFACES

FIELD OF THE DISCLOSURE

This disclosure relates generally to model topographies, and more particularly to methods and systems for an animated artificial water surface for model landscapes.

BACKGROUND

Modelers often include water features, such as lakes, rivers, waterfalls, and surf, in dioramas and miniature landscapes. Such water features increase scenic interest and greatly increase one's sense of presence. While it is easy to effectively model quiescent water features, such as swamps, lakes, and slow-moving rivers, it is challenging to model animated water features such as ripples, waves, rapids, and surf. To model such features, serious modelers typically rely on acrylic "casting plastic" and similar clear plastics. Modelled this way, the moving "water" can look remarkably real except that one has, in effect, only created a snapshot in time, since there is no actual motion. Unfortunately, the lack of motion breaks the illusion of reality.

One way overcome the above-described lack of motion is to use actual liquid water on miniature landscapes. Unfortunately, using real water can be messy and never looks "real" in miniature. To understand why, consider scale modeling of moving objects more generally. For example, suppose it takes 2 minutes for a train to cross an actual bridge. If one made an accurate HO-scale model of that train and bridge, the HO train should cross the miniature bridge in 2 minutes as well, since anything else would not look realistic. For the model train to cross the bridge in 2 minutes, the model train needs to travel at $1/87$ the speed of the full-size train, since HO is 1:87 scale.

In terms of a water feature, consider a real pond that ripples or waves cross in 2 minutes. If one modelled this pond in HO scale by creating a landform with a basin filled with real water, it is easy to induce tiny scale waves on the water. However, for accuracy, the induced waves should also cross the model pond in 2 minutes, but this would not be the case if real water were used. More specifically, a simple physics calculation, using the deep water approximation, shows that the scale waves would travel about $1/\sqrt{87}$ as fast as full-size waves, thereby crossing the model pond in just 13 seconds. This is wildly unrealistic, since the general expectation is for waves to drift lethargically across a pond and not zoom across it at what would look like highway speeds.

SUMMARY

Accordingly, it is an object of the present disclosure to describe methods and systems that model an animated artificial water surface for a variety of model landscapes.

Another object of the present disclosure is to describe methods and systems for creating animated water effects, while avoiding the messiness and maintenance issues inherent in using real water on model landscapes.

Other objects and advantages of the methods and systems described herein will become more obvious hereinafter in the specification and drawings.

In accordance with methods and systems described herein for modeling an animated artificial water surface, a sheet of material having a glossy surface includes a three-dimensional pattern of waves extending along horizontal dimensions of the sheet. The waves have a scale-model height profile. A drive may be coupled to the sheet. The drive may be operable to move at least a portion of the sheet continuously and at a constant speed in one direction relative to the horizontal dimensions of the sheet wherein the waves model an animated water surface.

BRIEF DESCRIPTION OF THE DRAWINGS

Other objects, features and advantages of the methods and systems described in the present disclosure will become apparent upon reference to the following description of the preferred embodiments and to the drawings, wherein corresponding reference characters indicate corresponding parts throughout the several views of the drawings and wherein.

DETAILED DESCRIPTION

The methods and systems described herein will allow a model designer/builder to model an animated artificial water surface that is scaled down in size relative to a real-life version of an animated water surface. As used herein, the word "animated" refers to a variety of water movements in a body of water to include, but not limited to, ripples, waves, surface currents, surf, etc. The phrase "artificial water surface" as used herein means that the methods and systems described herein do not require or use actual water thereby eliminating the complexities associated with such use. The animated artificial water surface may be part of an architectural model, an environmental or scientific model, a hobbyist's model, a historical model, etc., without departing from the scope of the present disclosure. In addition, the scaled size of the animated artificial water surface is not a limitation of the present disclosure.

Figure 1:
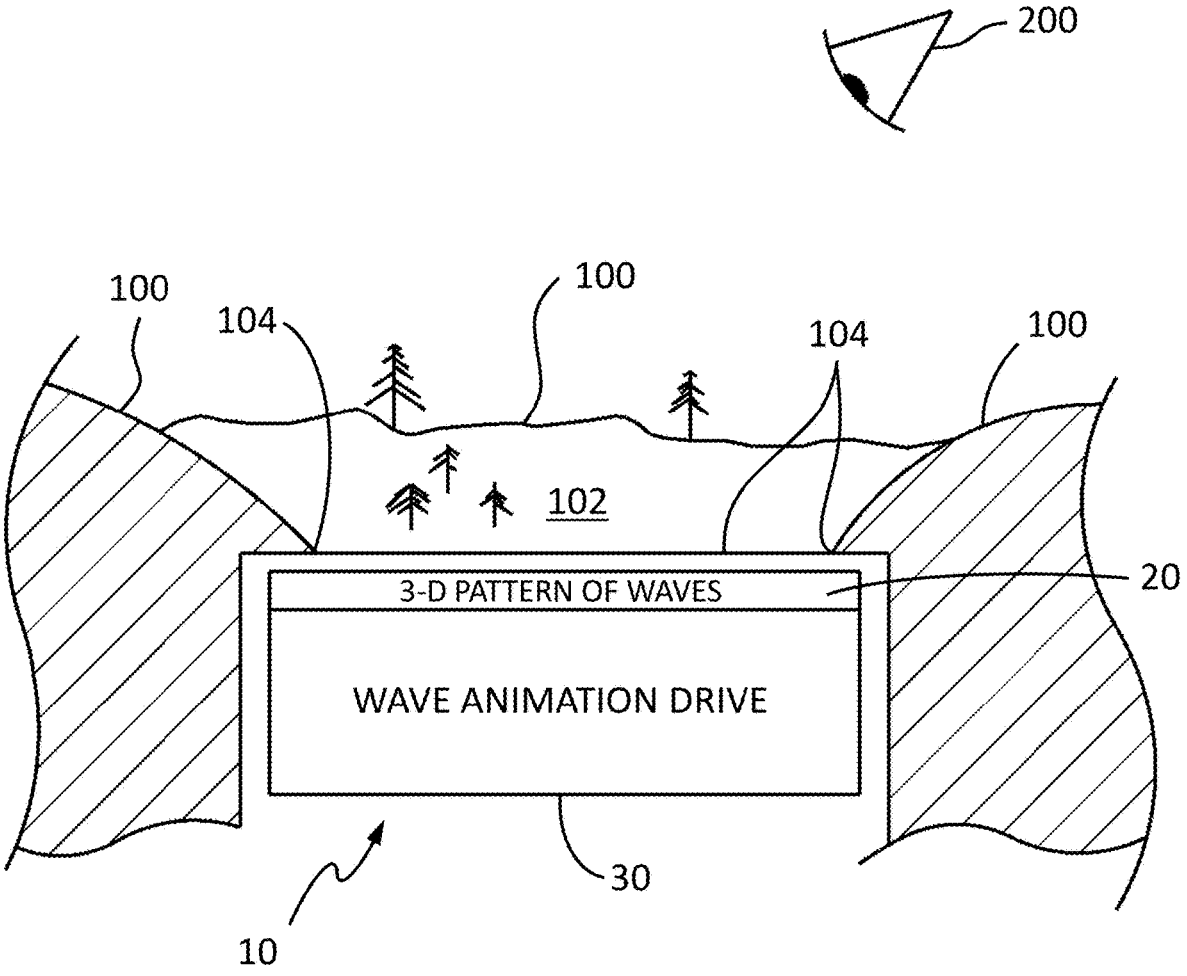
FIG. 1 is a schematic view of an embodiment of a system for modeling an animated artificial water surface in accordance with various aspects as described herein.

Referring now to the drawings and more particularly to FIG. 1, a system for modeling an animated artificial water surface is shown and is referenced generally by numeral 10. System 10 is shown installed as part of a model landscape that will generally include land regions 100 disposed about and creating an open basin 102 having a perimeter or shoreline 104 as will be explained further herein. System 10 includes a sheet of material 20 presenting a three-dimensional ("3-D") pattern of waves extending in both horizontal dimensions at the surface of sheet 20. Sheet 20 is positioned relative to land regions 100 and open basin 102 such that a portion of the 3-D pattern of waves presented on the surface of sheet 20 always spans open basin 102 to each portion of shoreline 104 and is always visible to an observer from above open basin 102 where such an observer is indicated generally by an eye 200.

To maintain the illusion of an animated water surface extending to the shoreline 104, some of sheet 20 (e.g., its edges) is excluded from the observer's view. In some embodiments, portions of sheet 20 within the shoreline 104 may also be excluded from the observer's view in order to preserve the illusion of an animated water surface. System 10 may also include a wave animation drive 30 coupled to sheet 20. As will be described later herein, drive 30 is operable to move sheet continuously and at a constant speed such that the 3-D pattern of waves at the surface of sheet 20 model an animated water surface.

Before describing the methods and systems presented herein, it is useful to briefly explain the dynamics of real ripples or waves moving across a water surface. In the real world, waves begin when an energy source excites a water surface. Such energy sources include wind and point sources, such as a splashing fountain, a waterfall, a paddle wheel, etc. Once the waves are created, they travel across the body of water evolving as they go, and finally die out as the energy is lost, e.g., as they crash into a shoreline. The methods and systems described herein model the wave propagation as this is the most visible phase of waves. However, in some embodiments, the methods and systems described herein may further include features providing the illusion of wave genesis.

To discuss the present disclosure's modeling of an animated water surface more precisely, it is useful to introduce a bit of mathematics. Non-breaking propagating waves on a body of real water may be described by a height function h(x,y,t), where h(x,y,*) shows the time evolution of the water height at spatial location (x,y). For a model landscape at scale 1/s where "s" is a scale factor, representation of a real body of water with a wave height function h(x,y,t) requires a corrected wave height function of h(sx,sy,t)/s. Note that the spatial dimensions (x,y) scale in accordance with the scale factor s, while the time dimension "t" does not. For simplicity and as will be used herein, a new height function H(x,y,t) may be defined as h(sx,sy,t)/s in which the scale s is implicit.

In general, system 10 models an animated artificial water surface that approximates the above-described model-scale time-dependent height function H(x,y,t) that describes the profile of propagating scale waves. By way of non-limiting examples, several embodiments of system 10 will be described herein. Each embodiment may be incorporated into a model landscape such as the one illustrated in FIG. 1. However, for clarity of illustration, each embodiment of system 10 will be shown in isolation.

When the surface of a lake or pond is excited by an energy "point source," such as a pulsing fountain, waterfall, paddle wheel bucket emptying onto a water surface, etc., the resulting surface waves are circular or spiral waves traveling radially outwards. Outward going spiral waves may be simulated in accordance with the present disclosure by a system 11 illustrated in the isolated views presented in FIGS. 2A and 2B. In turn, the outgoing spiral waves provide a realistic appearance of outward going circular waves.

Figure 2A:
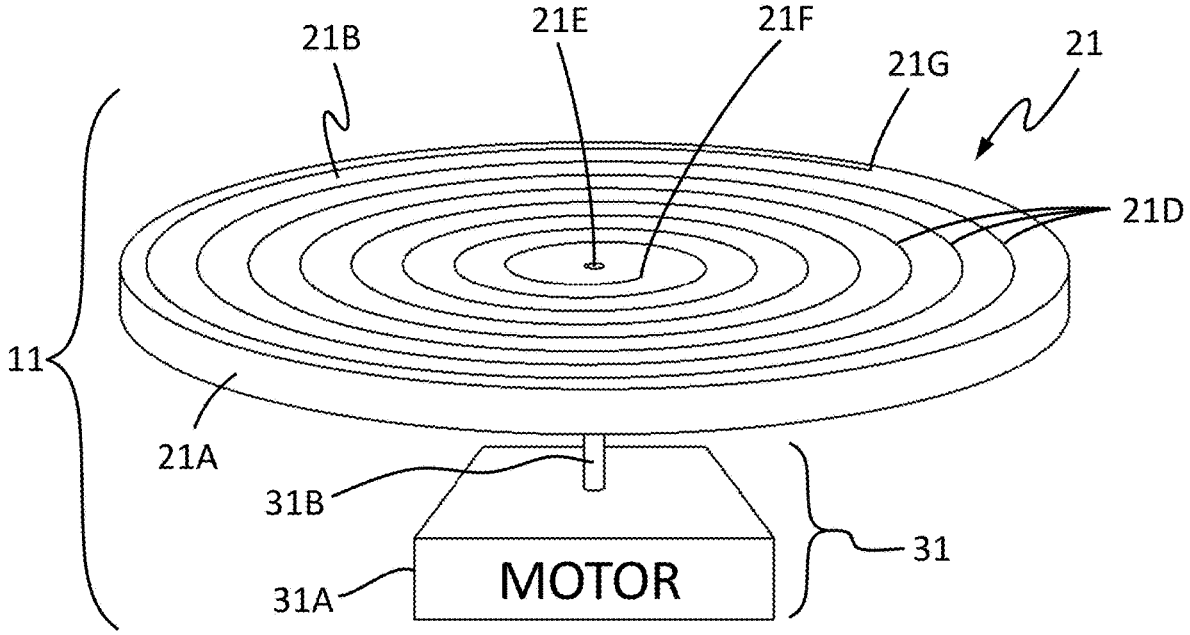
FIG. 2A is an isolated perspective view of one embodiment of a disk-based system having a three-dimensional spiral pattern of waves in accordance with various aspects as described herein.
Figure 2B:
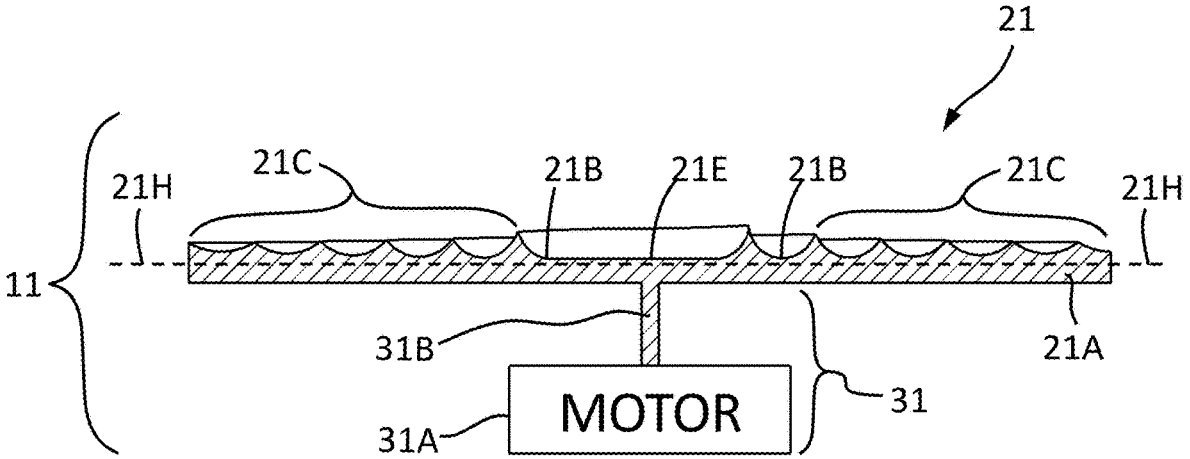
FIG. 2B is an isolated cross-sectional view of an embodiment of the disk-based system having decreasing height waves with increasing radius in accordance with various aspects as described herein.

Referring simultaneously to FIGS. 2A and 2B, system 11 includes a disk 21 serving as the above-described sheet 20 (FIG. 1) and a drive 31 serving as the above-described wave animation drive 30 (FIG. 1). In general, disk 21 includes a base region 21A and a glossy surface region 21B that includes the 3-D pattern of waves 21C (FIG. 2B) scaled down in size to match the scale of a model (not shown) that disk 21 is to be part of. The glossy attributes of surface region 21B may be fabricated using glossy materials, paint, etc., to give the appearance of a reflecting water surface as viewed from the perspective of an observer. In some embodiments, base region 21A and glossy surface region 21B to include waves 21C are constructed as an integrated structure, e.g., molded as one piece, stamped from a piece of sheet material, fused or otherwise coupled to one another, etc. In some embodiments, base region 21A and glossy surface region 21B to include waves 21C may be made from a transparent material to give the appearance of clear water as viewed from the perspective of the observer.

In general, waves 21C of glossy surface region 21B are formed by a spiral wave pattern 21D (FIG. 2A) where the center of the spiral wave is indicated by numeral 21E, and where the ends of the spiral wave are indicated by numerals 21F and 21G. End 21F is located at or near center 21E and end 21G is located at or near the edge of disk 21. In some embodiments and as shown in the illustrated example, center 21E of spiral wave pattern 21D is aligned with the drive shaft 31B of wave animation drive 31 such that, when operated, drive 31 rotates disk 21 in a two-dimensional plane (indicated by dashed line 21H) about center 21E.

The spiral wave pattern's wave heights are determined by the above-described model-scale time-dependent height function H(x,y,t). Accordingly, when rotated by drive 31 continuously in a single rotational direction at a constant rotational speed, waves 21C on the spinning disk 21 provide an accurate visual approximation of the above-described scaled height function H(x,y,t) of waves as they appear to be moving outward from the center 21E of the spiral wave pattern 21D. The speed of rotation may be adjusted such that waves 21C move at a pace to present the illusion of waves moving across a water surface at a realistic pace for the scale being used by the modeler.

To maintain the illusion of outgoing waves, ends 21F and 21G should be excluded from an observer's view when incorporated into a model landscape. For example, end 21G may be excluded from view as disk 21 extends beyond the shoreline (e.g., shoreline 104 illustrated in FIG. 1) of a model landscape, while end 21F may be excluded from view by shoreline 104 or by an artificial static feature (e.g., stand of artificial lily pads, artificial logs that appear to float on the water's surface, etc.) or by an artificial active feature (e.g., fountain, waterfall, etc.).

The cross-sectional shape of waves 21C may be configured in a variety of ways depending on the nature of the water surface being portrayed. In some embodiments, the spiral pattern's cross-sectional shape may be a changing-amplitude sinusoid whose maximum peak height occurs closest to center 21E. The wave heights may then decrease with increasing radial distance from center 21E where the minimum wave height occurs furthest from center 21E, i.e., near end 21G. When this type of spiral pattern is rotated as described above, the resulting animated artificial water surface will present ripples/waves that decrease in height with increasing radial distance from center 21E thereby mimicking what happens in real life when water ripples/waves decrease in height as they move away from their source. In some embodiments, the cross-sectional shape of the spiral pattern may be scallop-shaped. By way of a non-limiting example, FIG. 2B depicts a spiral pattern that presents waves 21C whose cross-section is a changing-amplitude scallop wave where a maximum wave height occurs closest to center 21E. The wave heights then decrease with increasing radial distance from center 21E with the minimum wave height occurring furthest from center 21E.

As mentioned above, system 11 also includes a drive 31 coupled to disk 21. Briefly, drive 31 may include a motor 31A and a drive shaft 31B coupled to disk 21. In the illustrated example, drive shaft 31B is coupled to disk 21 such that drive shaft 31B aligns with the center 21E of the spiral pattern. Motor 31A is operable to move (e.g., rotate) drive shaft 31B to thereby rotate disk 21 such that waves 21C move in correspondence with disk 21. More specifically, when motor 31A operates, disk 21 moves continuously in one rotational direction at a constant speed in two-dimensional plane 21H to thereby create the illusion of waves 21C moving outward from center 21E.

In some embodiments, the above-described sheet 20 (FIG. 1) may be realized by a glossy-surface endless belt. The endless belt's externally-facing surface may be made from glossy material(s) or present a glossy finish on any viewable portion thereof. In some embodiments, the endless belt may be transparent and have a glossy externally-facing surface. By way of a non-limiting example, an endless belt for use in a system that models an animated artificial water surface is shown in isolation in FIG. 3A and is referenced generally by numeral 22. FIG. 3B illustrates an isolated view of a system 12 that includes endless belt 22 and a wave animation drive 32.

Figure 3A:
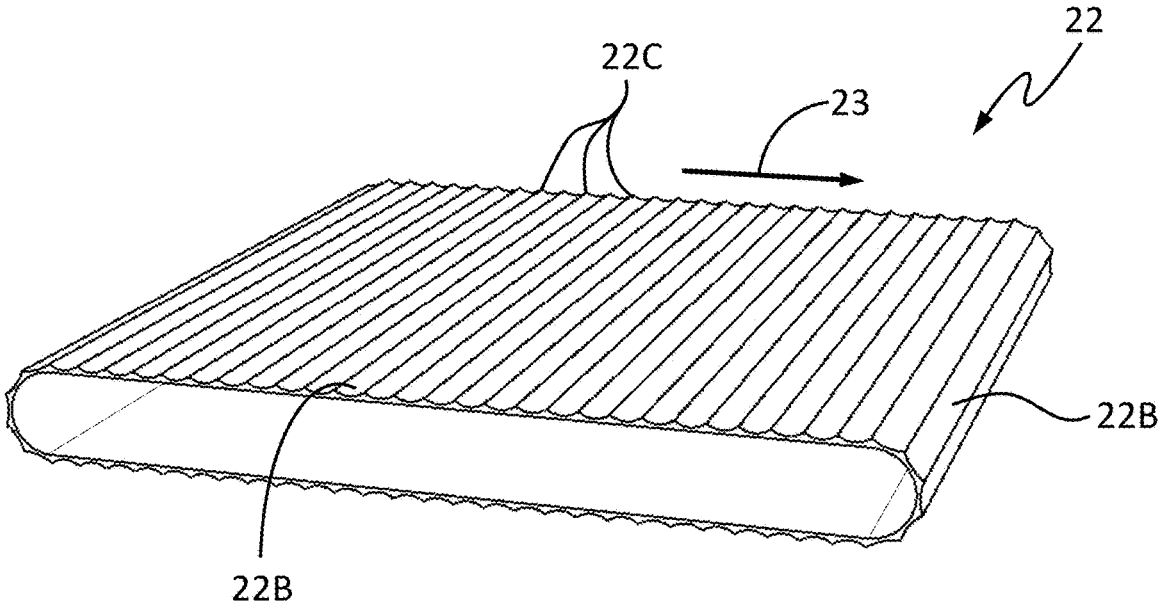
FIG. 3A is an isolated perspective view of an embodiment of an endless belt having a three-dimensional pattern of parallel waves in accordance with various aspects as described herein.
Figure 3B:
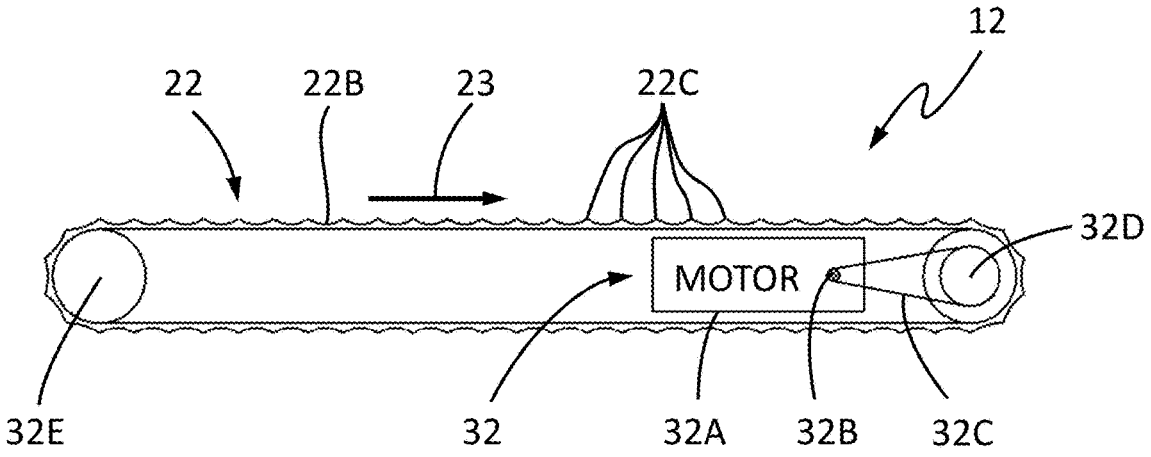
FIG. 3B is an isolated cross-sectional view of an embodiment of an endless belt-based system in accordance with various aspects as described herein.

Referring simultaneously to FIGS. 3A and 3B, endless belt 22 is typically made from flexible materials as would be understood in the art. In general, the externally-facing surface 22B of belt 22 includes a 3-D pattern of parallel waves 22C scaled down in size to match the scale of a model (not shown) that belt 22 is to be part of. The glossy attributes of waves 22C may be fabricated using glossy materials, paint, etc., to give the appearance of a reflecting water surface as viewed from the perspective of an observer. In the illustrated embodiment, a longitudinal cross-section of belt 22 reveals waves 22C that may present as a constant-amplitude sinusoid or scallop wave (as shown). When endless belt 22 is continuously rotated in one direction at a constant speed as indicated arrow 23, the corresponding 3-D pattern of waves 22C moves in correspondence with the endless belt. At any given time, the portion of the 3D-pattern that will be visible to an observer will appear as an animated artificial water surface having moving ripples/waves. For example, if belt 22 is used as sheet 20 in a model landscape such as that illustrated in FIG. 1, the viewable portion of belt 22 may be the top planar portion of endless belt 22 with the loop ends of the endless belt excluded from an observer's view by the shoreline 104 of the above-described open basin 102.

As mentioned above, system 12 (FIG. 3B) also includes a drive 32 coupled to belt 22. In the non-limiting illustrated example, drive 32 may include a motor 32A, a drive shaft 32B coupled to motor 32A, a drive belt 32C for coupling drive shaft 32B to a drive roller 32D positioned at one loop end of belt 22, and a free-wheel roller 32E positioned at the other loop end of belt 22. Motor 32A is operable to move (e.g., rotate) drive shaft 32B thereby causing drive belt 32C to rotate drive roller 32D such that belt 22 and waves 22C move continuously and at a constant speed as indicated by arrow 23 to thereby create the illusion of moving waves 22C.

Figure 4A:
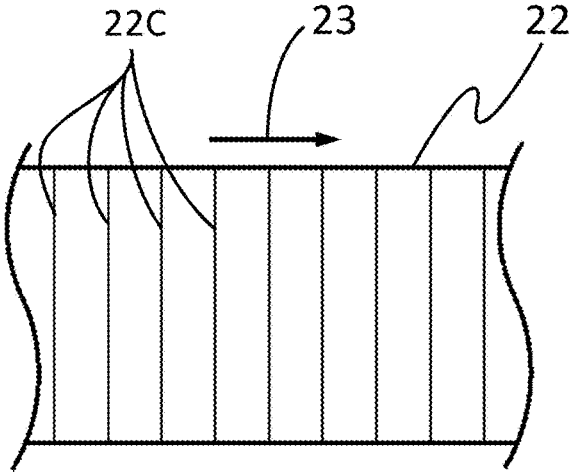
FIG. 4A is an isolated plan view of a portion of an endless belt having a three-dimensional pattern of parallel waves arranged perpendicularly relative to the belt's motion direction in accordance with various aspects as described herein.
Figure 4B:
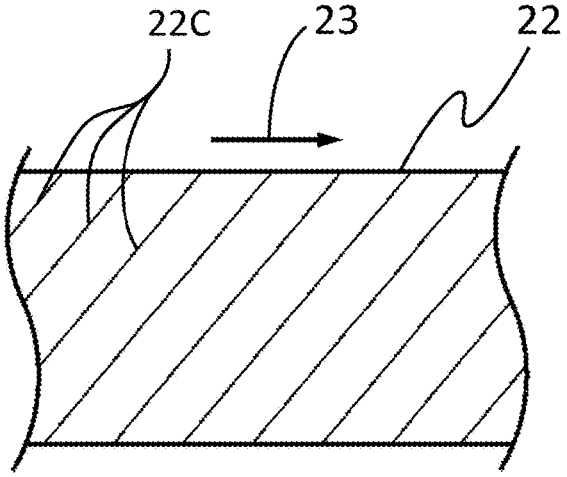
FIG. 4B is an isolated plan view of a portion of an endless belt having a three-dimensional pattern of parallel waves arranged non-perpendicularly relative to the belt's motion direction in accordance with various aspects as described herein.
Figure 4C:
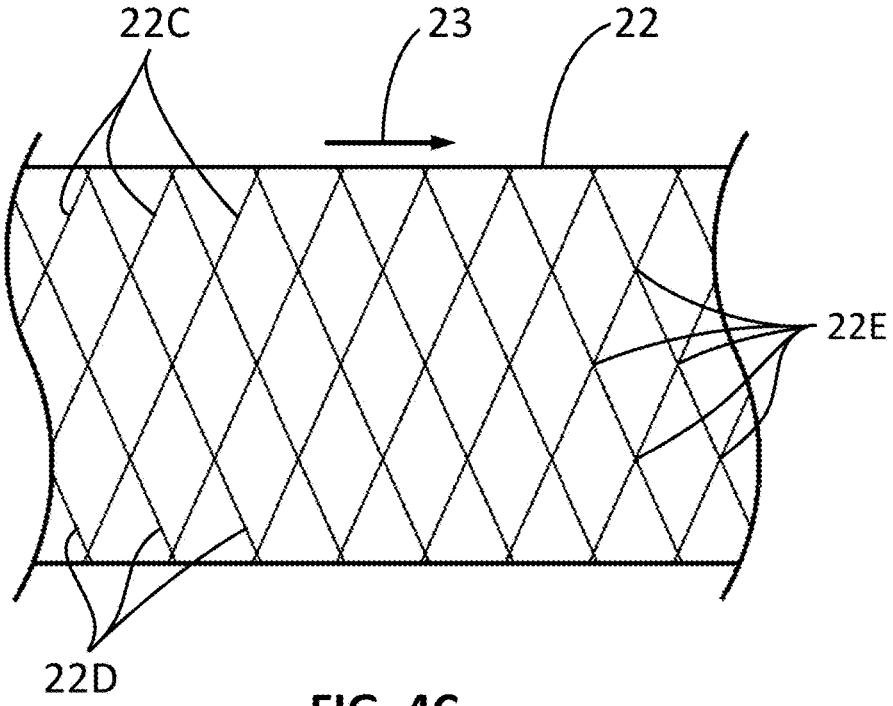
FIG. 4C is an isolated plan view of a portion of an endless belt having a three-dimensional pattern of intersecting parallel waves in accordance with various aspects as described herein.

The above-described parallel waves 22C are also shown in a plan view of belt 22 shown in FIG. 4A. In the real world, parallel waves tend to form on a pond, lake, river, etc., under the influence of a gentle breeze. While FIG. 4A illustrates waves 22C in a perpendicular relationship relative to motion direction 23, the present disclosure is not so limited. For example, FIG. 4B illustrates parallel waves 22C disposed in a non-perpendicular relationship to motion direction 23. Furthermore, it is to be understood that a variety of wave patterns may be accurately modelled by the endless belt-based system without departing from the scope of the present disclosure. For example, FIG. 4C illustrates two intersecting wave trains, i.e., parallel waves 22C intersecting parallel waves 22D. Both wave trains may have the same wave length, and may intersect one another at the same angle with respect to the motion direction 23 of belt 22. Waves 22C and 22D may have the same or different height amplitudes without departing from the scope of the present disclosure. In addition, waves 22C and 22D may have the same or different cross-sectional profiles without departing from the scope of the present disclosure. The intersections 22E of the waves may be constructed to mimic a real-world wave interaction.

Figure 5A:
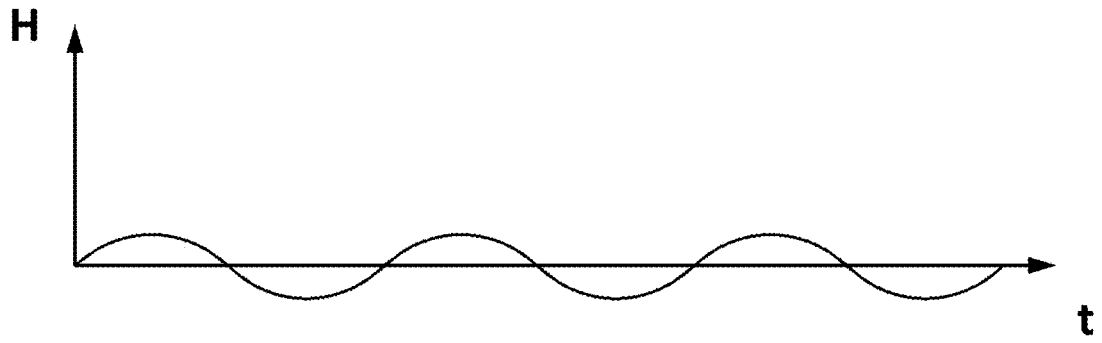
FIG. 5A is a graph of a time-varying height profile of an embodiment of a wave at the water surface with the wave having a single Fourier mode.
Figure 5B:
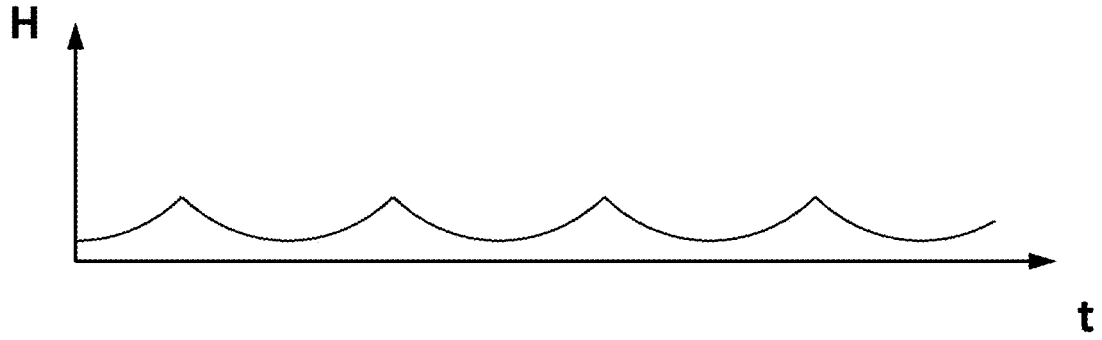
FIG. 5B is a graph of a time-varying height profile of an embodiment of a wave at water surface with the wave having multiple Fourier modes.
Figure 5C:
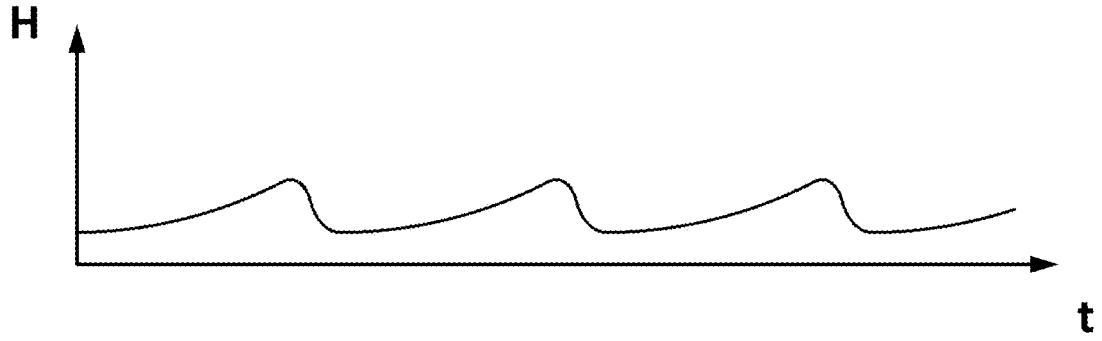
FIG. 5C is a graph of a time-varying height profile of another embodiment of a wave at water surface with the wave having multiple Fourier modes.

The methods and systems described herein will allow a modeler to accurately simulate waves in shallow-water and deep-water scenarios using 3-D wave patterns as described above. The wave patterns may be shaped/sized for a particular application using water wave theory. Briefly, waves change shape as they propagate as dictated by dissipation and dispersion. Dissipation is energy loss through turbulence and friction. Dispersion is change of the wave shape as the separate Fourier components of the waves travel at different speeds. FIGS. 5A-5C show graphs of the time-varying wave height of a water surface at a given location as a wave passes. As shown in FIG. 5A, a wave consisting of a single Fourier component is a perfect sinusoid. FIGS. 5B and 5C show the time-varying height of waves containing multiple Fourier modes.

The wavelength, A, of water waves is defined as the distance between adjacent wave peaks. In shallow water (i.e., water whose depth is much less than the wavelength), all Fourier components travel at the same speed such that there is no dispersion. Conversely, in deeper water, long wave lengths travel faster than short wave lengths and dispersion is typically obvious. Accordingly, using proper wave profile design, the above-described disk-based and belt-based methods and systems can model shallow-water or deep-water wave scenarios.

In some embodiments, features may be provided to enhance the model landscape. For example, features may be provided to give the illusion of being the genesis or source for the propagating artificial waves made possible by the methods and systems described herein. In general, the "source" may be 3-D feature(s) (e.g., a 3-D structure) that appear to deliver a periodic burst of energy to the artificial water surface (i.e., the 3-D pattern of waves) with a frequency that matches that of the artificial ripples/waves. That is, the illusory burst of energy should appear to impinge on a portion of the 3-D pattern of waves as the 3-D pattern moves past the "source". To assure such synchronization between the "source" and the 3-D pattern of ripples/waves, the "source" may be driven by the system's motor.

Figure 6A:
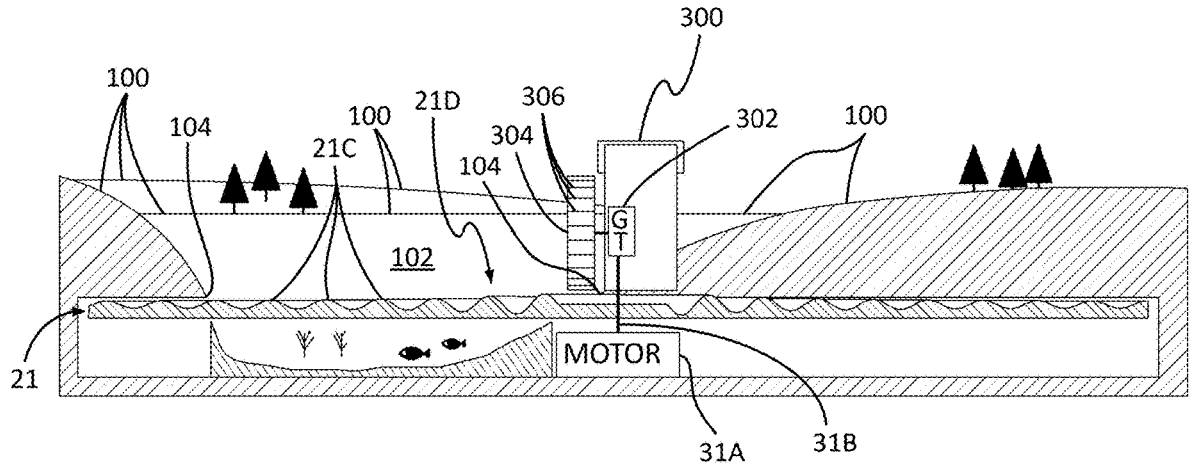
FIG. 6A is a sectional schematic view of a model landscape that further includes a grist mill model coupled to the animated artificial water surface system's disk-shaped base and three-dimensional pattern in accordance with various aspects as described herein.
Figure 6B:
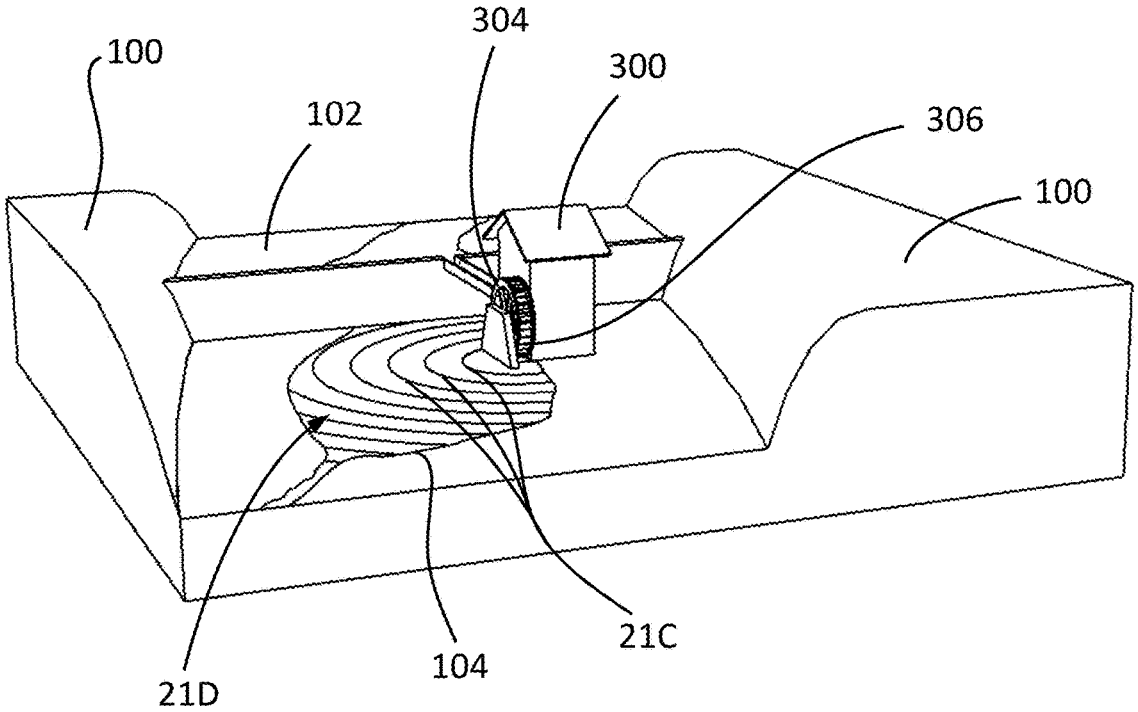
FIG. 6B is a perspective view of the model landscape that includes the grist mill model in accordance with various aspects as described herein.

By way of a non-limiting example, FIGS. 6A and 6B illustrate one such wave-source landscape enhancement where a grist mill 300 is positioned along shoreline 104 above the artificial water surface provided by the above-described disk-based system. Briefly, the motor's drive shaft 31B may be extended to cooperate with a gear train ("GT") 302 that, in turn, cooperates with a water wheel 304 having buckets or paddles 306 configured to appear to move towards 3-D spiral pattern 21D. The bucket 306 passing closest to 3-D spiral pattern 21D will then appear to "empty" just above and spaced apart from one of waves 21C. Thus, each bucket 306 of water wheel 304 serves as a 3-D feature "source" of the periodic burst of energy for each ripple/wave provided by 3-D spiral pattern 21D rotated by motor 31A.

If there are "N" buckets or paddles 306, gear train 302 may be configured to have a 1:N gear ratio so that the portion of 3-D spiral pattern 21D closest to water wheel 304 appears to be moving away from water wheel 304 each time a bucket or paddle 306 "empties" (i.e., rotates just above 3-D spiral pattern 21D). It is to be understood that other types of natural (e.g., a waterfall) or man-made (e.g., a pulsating water fountain) features could be used and coupled to motor 31A to create the illusion of the source of energy for the artificial ripples/waves without departing from the scope of the present disclosure.

The advantages of the methods and systems described herein are numerous. The animated artificial water surface requires no water but still provides the illusion of a realistic and animated water environment. The approach described herein may be used by professional and amateur model designers/builders. The artificial animated water surface may be constructed in a variety of ways using a variety of materials thereby allowing a model designer/builder to adapt the methods and systems described herein to create a variety of realistic animated water surface scenarios.

Although the methods and systems presented herein have been described for specific embodiments thereof, there are numerous variations and modifications that will be readily apparent to those skilled in the art in light of the above teachings. For example, the above-described disk with its 3-D pattern of waves at its surface having a height profile sized in accordance with a model scale may be used by a modeler in a variety of ways to provide a realistic looking animated artificial water surface. In some embodiments, a variety of additional features (e.g., reflectors, lights, audio, scents, etc.) may be included to further enhance the experience for an observer. It is therefore to be understood that, within the scope of the appended claims, the methods and systems presented herein may be practiced other than as specifically described.

What is claimed as new and desired to be secured by Letters Patent of the United States is:

1. A system for modeling an animated artificial water surface, comprising:

a sheet of material having a glossy surface wherein said sheet comprises a disk, said glossy surface including a three-dimensional pattern of waves extending along horizontal dimensions of said sheet, said waves having a scale-model height profile; and a drive coupled to said sheet and operable to move at least a portion of said sheet continuously and at a constant speed in one direction relative to said horizontal dimensions of said sheet, wherein said waves model an animated water surface.

2. The system of claim 1, wherein said glossy surface includes a raised spiral region having a center, and wherein a height of said raised spiral region decreases with a radial distance from said center of said raised spiral region.

3. The system of claim 2, wherein said drive is operable to rotate said sheet about a center of said raised spiral region.

4. The system of claim 1, wherein said sheet is transparent.

5. The system of claim 1, further comprising:

a three-dimensional feature coupled to said drive to experience movement when said drive is operated to move said sheet, wherein said movement provides a visual indication of a source of energy for said waves modeling the animated water surface.

6. A system for modeling an animated artificial water surface, comprising:

a sheet of material having a glossy surface wherein said sheet comprises a disk, said glossy surface including a three-dimensional pattern of waves extending along horizontal dimensions of said sheet; and a drive coupled to said sheet and operable to move at least a portion of said sheet continuously and at a constant speed, wherein a time-varying height of said portion of said sheet relative to said horizontal dimensions matches a model-scale time-dependent height profile H(x,y,t) of propagating scale waves.

7. The system of claim 6, wherein said glossy surface includes a raised spiral region having a center, and wherein a height of said raised spiral region decreases with a radial distance from said center of said raised spiral region.

8. The system of claim 7, wherein said drive is operable to rotate said sheet about a center of said raised spiral region.

9. The system of claim 6, wherein said sheet is transparent.

10. The system of claim 6, further comprising:

a three-dimensional feature disposed above said sheet; and said three-dimensional feature coupled to said drive to experience movement when said drive is operated to move said sheet, wherein said movement provides a visual indication of a source of energy for the propagating scale waves having the model-scale time-dependent height profile H(x,y,t).

11. A method for modeling an animated artificial water surface, comprising:

by a model landscape including a land region adjacent to an open basin having a perimeter with the model landscape being sized in accordance with a model scale, and a sheet of material having a glossy surface with the glossy surface including a three-dimensional (3-D) pattern of waves extending along horizontal dimensions of the sheet with the waves having a height profile sized in accordance with the model scale, wherein the sheet is disposed partially under the land region wherein a portion of the sheet spans the open basin, wherein a portion of the 3-D pattern lies within the perimeter, and wherein a remainder of the 3-D pattern is concealed by the land region, moving at least a portion of the sheet continuously and at a constant speed in one direction relative to the horizontal dimensions of the sheet wherein the waves model an animated water surface at the open basin.

12. The method of claim 11, wherein the sheet comprises a disk.

13. The method of claim 11, wherein the glossy surface includes a raised spiral region having a center, and wherein a height of the raised spiral region decreases with a radial distance from the center of the raised spiral region.

14. The method of claim 13, wherein the step of moving comprises rotating the disk in a two-dimensional plane about a center of the raised spiral region.

15. The method of claim 11, wherein the sheet comprises an endless belt.

16. The method of claim 11, further comprising:

positioning a three-dimensional feature above the sheet; and coupling the three-dimensional feature to the drive, wherein the three-dimensional sheet experiences movement when the drive is moving the sheet, and wherein the movement provides a visual indication of a source of energy for the waves modeling the animated water surface.

17. An apparatus for modeling an animated artificial water surface, comprising:

a sheet of material having a glossy surface, said glossy surface including a three-dimensional (3-D) pattern of waves extending along horizontal dimensions of said sheet, said waves having a height profile sized in accordance with a model scale, said sheet being adapted to be part of a model landscape that includes a land region adjacent to an open basin having a perimeter with the model landscape being sized in accordance with a model scale, wherein a portion of said 3-D pattern lies within the perimeter, and wherein a remainder of said 3-D pattern is concealed by the land region, and said sheet adapted to be coupled to a drive that is operable to move at least a portion of said sheet continuously and at a constant speed in one direction relative to said horizontal dimensions of said sheet, wherein said waves model an animated water surface at the open basin.

18. The apparatus of claim 17, wherein said sheet comprises a disk.

19. The apparatus of claim 17, wherein said glossy surface includes a raised spiral region having a center, and wherein a height of said raised spiral region decreases with a radial distance from said center of said raised spiral region.

20. The apparatus of claim 19, wherein the drive is operable to rotate said sheet about a center of said raised spiral region.

21. The apparatus of claim 17, wherein said sheet is transparent.

* * * * *